US006142701A

United States Patent [19]

Falcon

[11] Patent Number: 6,142,701

[45] Date of Patent: Nov. 7, 2000

[54] TRAFFIC MANAGEMENT SYSTEM

[76] Inventor: George Falcon, 1586 Singingwood Ave., Pomona, Calif. 91767

[21] Appl. No.: 09/195,973

[22] Filed: Nov. 19, 1998

[51] Int. Cl.[7] ..... E04H 17/16

[52] U.S. Cl. ..... 404/6; 404/9; 256/1; 256/24; 160/24

[58] Field of Search ..... 256/1, 24, 13.1; 404/6, 9; 362/194, 431; 116/63 C; 160/24

[56] References Cited

U.S. PATENT DOCUMENTS

| | | | |
|---|---|---|---|
| 2,954,005 | 9/1960 | Cioffi et al. . | |
| 3,222,509 | 12/1965 | Thedford . | |
| 3,247,823 | 4/1966 | Buck et al. . | |
| 3,451,368 | 6/1969 | Keats . | |
| 3,866,034 | 2/1975 | Russo . | |
| 3,913,518 | 10/1975 | Kaplan | 116/63 C |
| 4,119,301 | 10/1978 | Payne . | |
| 4,681,302 | 7/1987 | Thompson . | |
| 5,029,819 | 7/1991 | Kane . | |
| 5,498,101 | 3/1996 | Braverman . | |
| 5,504,397 | 4/1996 | Chien . | |
| 5,560,732 | 10/1996 | Kulp et al. | 404/10 |
| 5,660,144 | 8/1997 | Venti . | |
| 5,888,016 | 3/1999 | Ahn . | |
| 6,014,941 | 1/2000 | Bent et al. | 116/63 R |

*Primary Examiner*—James A. Lisehora

[57] ABSTRACT

A traffic management system is provided including a primary dispensing post and a banner having an inboard coupled to the primary dispensing post to be dispensed and retracted by way of a crank. The banner has traffic managing indicia positioned thereon. Further, a terminal post is connected to an outboard edge of the banner for maintaining the same upright.

9 Claims, 2 Drawing Sheets

2
2
10
50
44
40
30
32
12
46
3
14
20
42

24
18

20
12
16
22
14

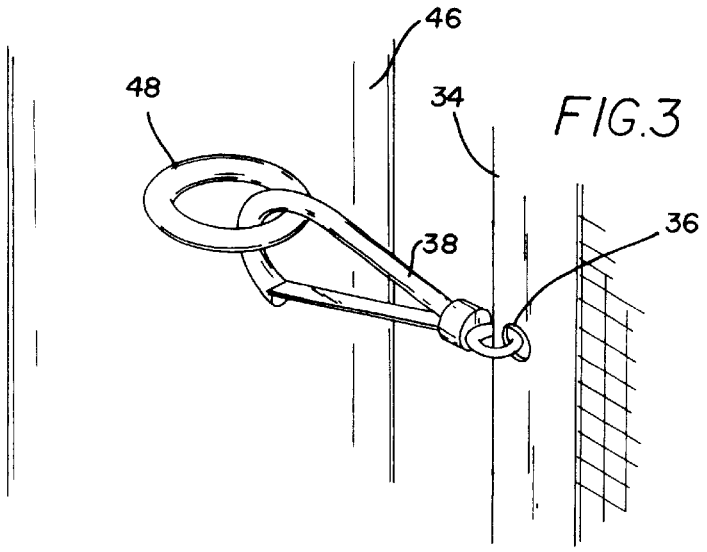
FIG.3
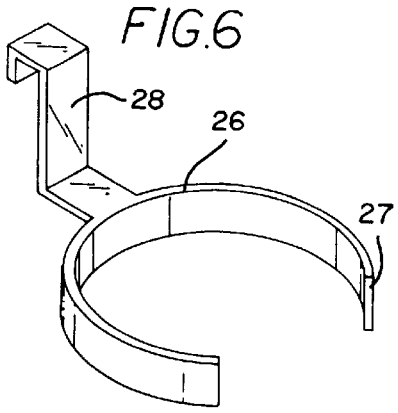
FIG.6
FIG.4
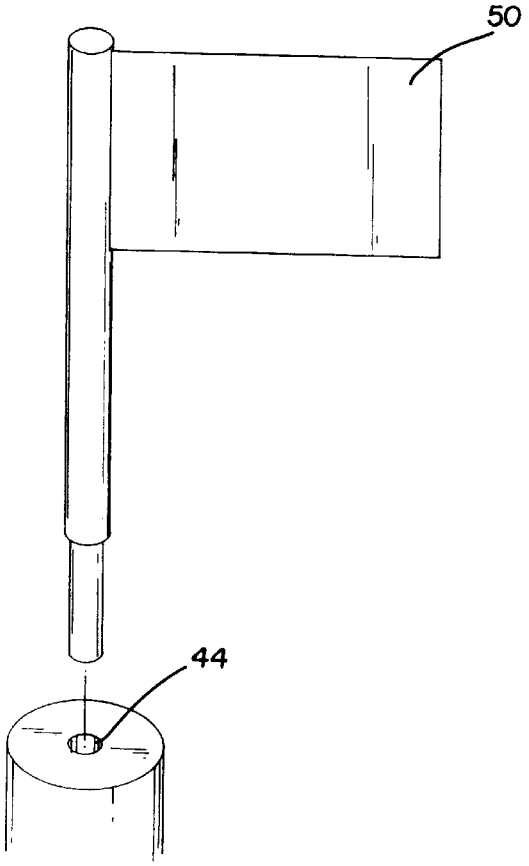
FIG.5
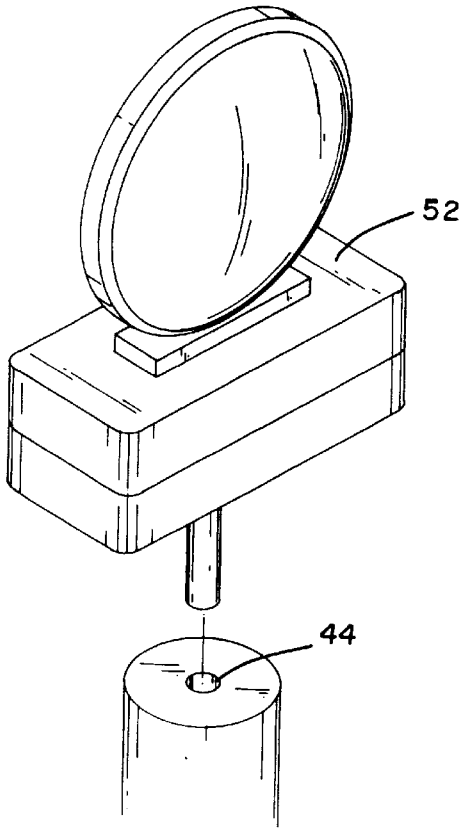

TRAFFIC MANAGEMENT SYSTEM

BACKGROUND OF THE INVENTION

1 Field of the Invention

The present invention relates to portable screens and boundaries and more particularly pertains to a new traffic management system for conveniently directing traffic on a highway or a freeway.

2 Description of the Prior Art

The use of portable screens and boundaries is known in the prior art. More specifically, portable screens and boundaries heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,124,196; U.S. Pat. No. 4,186,912; U.S. Pat. No. 4,844,420; U.S. Pat. No. 5,269,623; U.S. Pat. No. 4,119,301; and U.S. Patent Des. 341,429.

In these respects, the traffic management system according to the present invention substantially departs from the conventional concepts and designs of the prior art, and in so doing provides an apparatus primarily developed for the purpose of conveniently directing traffic on a highway or a freeway.

SUMMARY OF THE INVENTION

In view of the foregoing disadvantages inherent in the known types of portable screens and boundaries now present in the prior art, the present invention provides a new traffic management system construction wherein the same can be utilized for conveniently directing traffic on a highway or a freeway.

The general purpose of the present invention, which will be described subsequently in greater detail, is to provide a new traffic management system apparatus and method which has many of the advantages of the portable screens and boundaries mentioned heretofore and many novel features that result in a new traffic management system which is not anticipated, rendered obvious, suggested, or even implied by any of the prior art portable screens and boundaries, either alone or in any combination thereof.

To attain this, the present invention generally comprises a primary dispensing post having a disk-shaped base. As shown in FIG. 2, such base has a planar circular bottom face, a planar circular top face, and a thin peripheral side wall formed therebetween. The base is thus adapted for housing weighted material therein. The primary dispensing post further includes a vertically oriented cylindrical body with a diameter less than that of the base. The body is preferably coupled to the base in concentric relationship therewith and extending upwardly therefrom. As such, a hollow interior space is defined. The body has a top face with a diameter greater than that of the cylindrical body thus defining a peripheral flange. A vertical slit is formed in the body and extends along an entire height thereof. The primary dispensing post includes a spool having a bottom end with a reduced diameter for being rotatably received within a recess formed in the top face of the base. A top end of the spool is equipped with a crank mounted thereon. As shown in FIG. 2, such crank extends through the top face of the body for allowing the manual rotation of the spool in coaxial relationship with the body. Ideally, the crank has an S-shaped configuration.

FIG. 6 shows a bracket including a resilient C-shaped clip with a diameter equal to that of the body of the primary dispensing post. The clip of the bracket is thus adapted for snappily receiving the body. Mounted on a central extent of the clip is an inverted J-shaped hook. The hook extends upwardly and outwardly from the clip for being secured to a vehicle. FIG. 1 shows a banner constructed from a brightly colored flexible meshed net material. An inboard edge of the banner is mounted to the spool within the interior space of the body. As such, the banner may be dispensed and retracted through the slit of the body by way of the crank. Ideally, the banner has a plurality of arrows positioned thereon in tandem. The arrows preferably extend along a central horizontally oriented bisecting line such that the arrows point toward the inboard edge of the banner. As shown in FIG. 3, the banner further includes a reinforcing strip mounted along an outboard edge with a plurality of linearly aligned apertures formed therein. For reasons that will soon become apparent, a plurality of snap hooks are coupled to the apertures. FIG. 1 shows that the banner further includes a plurality of vertically spaced pairs of loops formed on a top edge and a bottom edge of the banner. A plurality of intermediate posts are provided each with a base and body similar to that of the primary dispensing post with the exception of a concentric bore formed in a top face thereof. In use, the body of each intermediate post is slidably and removably positioned within the vertically spaced pairs of loops of the banner for maintaining the banner in an upright orientation. FIG. 1 shows a terminal post including a disk-shaped base with a base and body similar to that of the primary dispensing post with the exception of a concentric bore formed in a top face thereof. The terminal post, however, further includes a plurality of vertically spaced O-rings for releasably receiving the snap hooks of the banner to maintain the banner in the upright orientation. FIG. 4 shows a flag attachment including an upright member with a bottom end having a reduced diameter for being releasably received within the bore of the intermediate and terminal posts. A top end of the upright member is equipped with a flexible sheet mounted thereon. Associated therewith is a light attachment including a battery supply having a top face with a light mounted thereon. The light is connected to the battery supply for illuminating intermittently. A bottom face of the battery supply has a coupling rod for being releasably received within the bore of the intermediate and terminal posts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new traffic management system apparatus and method which has many of the advantages of the portable screens and boundaries mentioned heretofore and many novel features that result in a new traffic management system which is not anticipated, rendered obvious, suggested, or even implied by any of the prior art portable screens and boundaries, either alone or in any combination thereof.

It is another object of the present invention to provide a new traffic management system which may be easily and efficiently manufactured and marketed.

It is a further object of the present invention to provide a new traffic management system which is of a durable and reliable construction.

An even further object of the present invention is to provide a new traffic management system which is susceptible of a low cost of manufacture with regard to both materials and labor, and which accordingly is then susceptible of low prices of sale to the consuming public, thereby making such traffic management system economically available to the buying public.

Still yet another object of the present invention is to provide a new traffic management system which provides in the apparatuses and methods of the prior art some of the advantages thereof, while simultaneously overcoming some of the disadvantages normally associated therewith.

Still another object of the present invention is to provide a new traffic management system for conveniently directing traffic on a highway or a freeway.

Even still another object of the present invention is to provide a new traffic management system that includes a primary dispensing post and a banner having an inboard coupled to the primary dispensing post to be dispensed and retracted by way of a crank. The banner has traffic managing indicia positioned thereon. Further, a terminal post is connected to an outboard edge of the banner for maintaining the same upright.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the interconnection between the terminal post and the banner of the present invention.

FIG. 4 is an exploded view of one of the posts and the flag attachment of the present invention.

FIG. 5 is an exploded view of one of the posts and the light attachment of the present invention.

FIG. 6 is a perspective view of the bracket of the present invention.

DESCRIPTION OF THE PREFERRED EMBODIMENT

Figure 1:
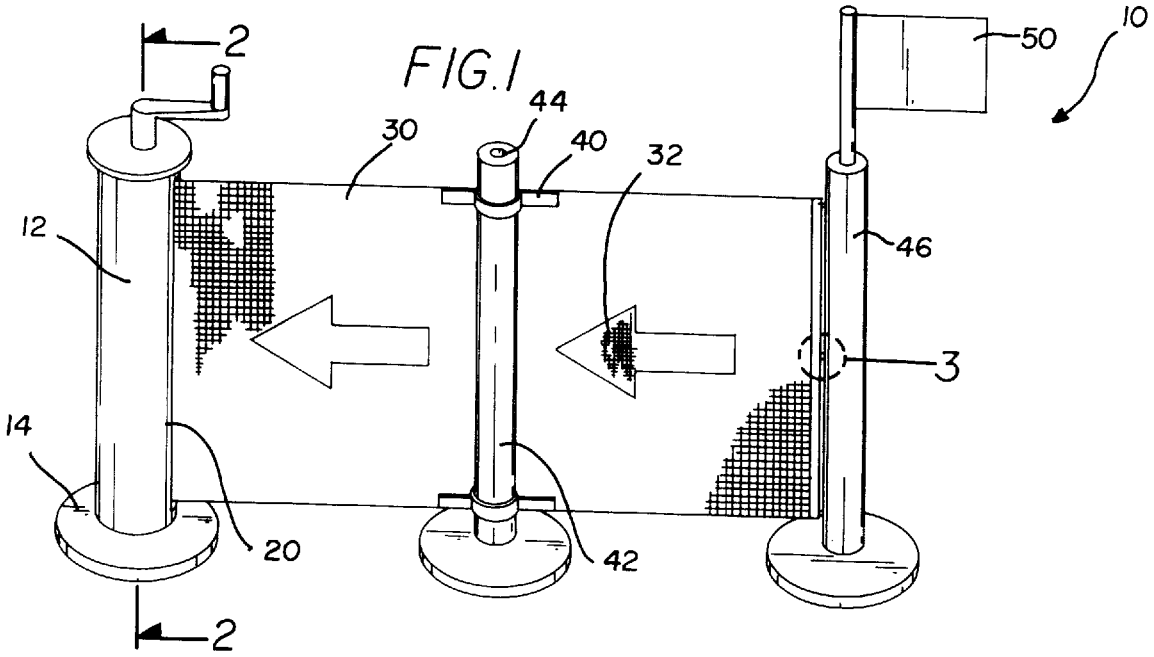
FIG. 1 is a front view of a new traffic management system according to the present invention.

With reference now to the drawings, and in particular to FIGS. 1 through 6 thereof, a new traffic management system embodying the principles and concepts of the present invention and generally designated by the reference numeral 10 will be described.

Figure 2:
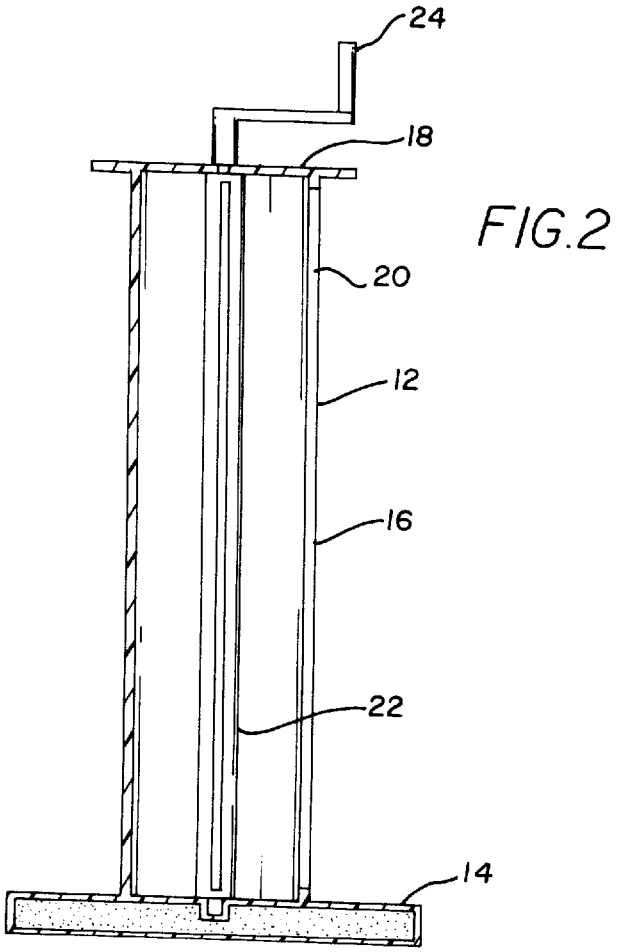
FIG. 2 is a side cross-sectional view of the present invention taken along line 2—2 shown in FIG. 1.

The present invention, designated as numeral 10, includes a primary dispensing post 12 having a rubber disk-shaped base 14. As shown in FIG. 2, such base has a planar circular bottom face, a planar circular top face, and a thin peripheral side wall formed therebetween. The base is thus adapted for housing weighted material therein.

The primary dispensing post further includes a vertically oriented cylindrical body 16 with a diameter less than that of the base. The body is preferably coupled to the base in concentric relationship therewith and extending upwardly therefrom. As such, a hollow interior space is defined. The body has a top face 18 with a diameter greater than that of the cylindrical body thus defining a peripheral flange. A vertical slit 20 is formed in the body and extends along an entire height thereof.

The primary dispensing post includes a spool 22 having a bottom end with a reduced diameter for being rotatably received within a recess formed in the top face of the base. Note FIG. 2. A top end of the spool is equipped with a crank 24 mounted thereon. As shown in FIG. 2, such crank extends through the top face of the body for allowing the manual rotation of the spool in coaxial relationship with the body. Ideally, the crank has an Sshaped configuration.

FIG. 6 shows a bracket 26 including a resilient C-shaped clip 27 with a diameter equal to that of the body of the primary dispensing post. The clip of the bracket is thus adapted for snappily receiving the body. As an option, the clip may form a closed loop and rely on a clasp to be opened. Mounted on a central extent of the clip is an inverted J-shaped hook 28. The hook extends upwardly and outwardly from the clip for being secured to a vehicle. The primary dispensing post may thus be transported in a convenient manner.

FIG. 1 shows a banner 30 constructed from a nylon orange colored flexible meshed net material. An inboard edge of the banner is mounted to the spool within the interior space of the body. As such, the banner may be dispensed and retracted through the slit of the body by way of the crank. Ideally, the banner has a length of 200 feet and a height of 4–6 feet.

Ideally, the banner has a plurality of arrows 32 positioned thereon in tandem. The arrows preferably extend along a central horizontally oriented bisecting line such that the arrows point toward the inboard edge of the banner. As an option, the arrow may be configured to point in opposite directions on either side of the banner, respectively. As shown in FIG. 3, the banner further includes a reinforcing strip 34 mounted along an outboard edge with a plurality of linearly aligned apertures 36 formed therein. For reasons that will soon become apparent, a plurality of snap hooks 38 are coupled to the apertures. FIG. 1 shows that the banner further includes a plurality of vertically spaced pairs of loops 40 formed on a top edge and a bottom edge of the banner every 10–12 feet. Such loops are preferably defined by parallel elastic strips coupled at ends thereof to the banner.

A plurality of intermediate posts 42 are provided each with a base and body similar to that of the primary dispensing post with the exception of a concentric bore 44 formed in a top face thereof. In use, the body of each intermediate post is slidably and removably positioned within the vertically spaced pairs of loops of the banner for maintaining the banner in an upright orientation.

FIG. 1 shows a terminal post 46 including a disk-shaped base with a base and body similar to that of the primary dispensing post with the exception of a concentric bore formed in a top face thereof. The terminal post, however, further includes a plurality of vertically spaced and horizontally oriented O-rings 48 for releasably receiving the snap hooks of the banner to maintain the banner in the upright orientation.

FIG. 4 shows a flag attachment 50 including an upright member with a bottom end having a reduced diameter for being releasably received within the bore of the intermediate and terminal posts. A top end of the upright member is equipped with a flexible sheet mounted thereon. Associated therewith is a light attachment 52 including a battery supply having a top face with a light mounted thereon. The light is connected to the battery supply for illuminating intermittently. A bottom face of the battery supply has a coupling rod for being releasably received within the bore of the intermediate and terminal posts.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A traffic management system comprising, in combination:

a primary dispensing post including a disk-shaped base having a planar circular bottom face, a planar circular top face, and a thin peripheral side wall formed therebetween for housing weighted material therein, the primary dispensing post further including a vertically oriented cylindrical body with a diameter less than that of the base and coupled thereto in concentric relationship therewith and extending upwardly therefrom to define a hollow interior space, the body having a top face with a diameter greater than that of the cylindrical body thus defining a peripheral flange, a vertical slit formed in the body and extending along an entire height thereof, and a spool including a bottom end with a reduced diameter for being rotatably received within a recess formed in the top face of the base and a top end with a crank mounted thereon and extending through the top face of the body for allowing the manual rotation of the spool in coaxial relationship with the body;

a bracket including a resilient C-shaped clip with a diameter equal to that of the body of the primary dispensing post for snappily receiving the body and an inverted J-shaped hook mounted on a central extent of the clip and extending upwardly and outwardly therefrom for being secured to a vehicle;

a banner constructed from a brightly colored flexible meshed net material with an inboard edge mounted to the spool within the interior space of the body such that the banner may be dispensed and retracted through the slit of the body by way of the crank, wherein the banner has a plurality of arrows positioned thereon in tandem along a central horizontally oriented bisecting line such that the arrows point toward the inboard edge of the banner, the banner further including a reinforcing strip mounted along an outboard edge thereof, a plurality of linearly aligned apertures formed in the strip, and a plurality of snap hooks coupled to the apertures, the banner further including a plurality of pairs of vertically spaced loops, one loop of one said pair being formed on a top edge and another loop of one said pair being formed on a bottom edge of the banner;

a plurality of intermediate posts each including a disk-shaped base including a planar circular bottom face, a planar circular top face, and a thin peripheral side wall formed therebetween for housing weighted material therein, the intermediate post further including a vertically oriented cylindrical body with a diameter less than that of the base and coupled thereto in concentric relationship therewith and extending upwardly therefrom with a top face including a concentric bore formed therein, wherein the body of each intermediate post is slidably and removably positioned within the vertically spaced pairs of loops of the banner for maintaining the banner in an upright orientation;

a terminal post including a disk-shaped base having a planar circular bottom face, a planar circular top face, and a thin peripheral side wall formed therebetween for housing weighted material therein, the terminal post further including a vertically oriented cylindrical body with a diameter less than that of the base and coupled thereto in concentric relationship therewith and extending upwardly therefrom with a top face including a concentric bore formed therein, wherein the body of the terminal post includes a plurality of vertically spaced O-rings for releasably receiving the snap hooks of the banner for maintaining the banner in the upright orientation;

a flag attachment including an upright member with a bottom end having a reduced diameter for being releasably received within the bore of the intermediate and terminal posts and a top end with a flexible sheet mounted thereon; and a light attachment including a battery, supply having a top face with a light mounted thereon and connected to the battery supply for illuminating intermittently and a bottom face with a coupling rod for being releasably received within the bore of the intermediate and terminal posts.

2. A traffic management system comprising:

a primary dispensing post including a base adapted for housing weighted material therein, the primary dispensing post further including a vertically oriented body coupled to the base and extending upwardly from the base, a slit formed in the body and extending along a length thereof, and a spool rotatably received in an interior space of the body, a crank mounted on the body and extending through a top face of the body for allowing the manual rotation of the spool with respect to the body;

a bracket including a resilient C-shaped clip adapted for receiving the body and a hook mounted on the clip for securing to a vehicle;

a banner constructed from a flexible meshed net material with an inboard edge mounted to the spool in the interior space of the body such that the banner may be dispensed and retracted through the slit of the body by way of the crank, wherein the banner has a plurality of arrows marked thereon, a plurality of pairs of vertically spaced loops, one loop of one said pair being formed on a top edge and another loop of one said pair being formed on a bottom edge of the banner;

at least one intermediate post including a base adapted for housing weighted material therein, the intermediate post further including a body coupled to the base and extending upwardly from the base, wherein the body of the intermediate post is removably positionable in the pairs of loops of the banner for maintaining the banner in an upright orientation; and a terminal post including a base adapted for housing weighted material therein, the terminal post further including a body coupled to the base and extending upwardly from the base, wherein the body of the terminal post includes a plurality of vertically spaced O-rings for releasably receiving snap hooks mounted on the banner for maintaining the banner in the upright orientation.

3. A traffic management system as set forth in claim 2 wherein each of the bases of the posts is weighted for enhancing the stability of the post.

4. A traffic management system as set forth in claim 2 and further including a flag attachment removably coupled to at least one of the posts.

5. A traffic management system as set forth in claim 2 and further including a light attachment removably coupled to at least one of the posts.

6. The system of claim 2 additionally comprising a light attachment including a battery unit having a light mounted thereon and connected to a battery in the battery unit for intermittently illuminating the light, the battery unit having a coupling rod for being releasably received in a bore of the intermediate and terminal posts.

7. The system of claim 2 wherein the body of the terminal post and the base of the terminal post each have a width measured perpendicular to a longitudinal length of the post, and wherein the width of the body is approximately one-third of the width of the base.

8. The system of claim 2 wherein the body of the dispensing post and the base of the dispensing post each have a width measured perpendicular to a longitudinal length of the post, and wherein the width of the body is approximately one-half of the width of the base.

9. The system of claim 2 where in the body of the terminal post and the base of the terminal post each have a width measured perpendicular to a longitudinal length of the post, and wherein the width of the body of the terminal post is approximately one-third of the width of the base of the terminal post, and wherein the body of the dispensing post and the base of the dispensing post each have a width measured perpendicular to a longitudinal length of the post, and wherein the width of the body of the dispensing post is approximately one-half of the width of the base of the dispensing post.

* * * * *